US011331708B2

(12) United States Patent
Bruyas et al.

(10) Patent No.: US 11,331,708 B2
(45) Date of Patent: May 17, 2022

(54) BENDING MACHINE AND PROCESS

(71) Applicant: NUMALLIANCE, Saint-Michel-sur-Meurthe (FR)

(72) Inventors: Jean-Paul Bruyas, Charly (FR); Joël Etienne, St die des Vosges (FR)

(73) Assignee: NUMALLIANCE, Saint-Michel-sur-Meurthe (FR)

( * ) Notice: Subject to any disclaimer, the term of this patent is extended or adjusted under 35 U.S.C. 154(b) by 0 days.

(21) Appl. No.: 17/129,092

(22) Filed: Dec. 21, 2020

(65) Prior Publication Data

US 2021/0187573 A1 Jun. 24, 2021

(30) Foreign Application Priority Data

Dec. 23, 2019 (FR) ..... 1915509

(51) Int. Cl.
*B21D 7/08* (2006.01)
*B21D 7/16* (2006.01)

(52) U.S. Cl.
CPC ..... *B21D 7/08* (2013.01); *B21D 7/16* (2013.01)

(58) Field of Classification Search
CPC ..... B21D 7/02; B21D 7/022; B21D 7/024; B21D 7/03; B21D 7/16; B23Q 3/155
USPC ..... 72/149, 156, 159, 306, 307
See application file for complete search history.

(56) References Cited

U.S. PATENT DOCUMENTS 4,987,760 A * 1/1991 Schulte ..... B21D 11/10 72/306
5,343,725 A * 9/1994 Sabine ..... B21D 7/024 72/149
5,884,517 A * 3/1999 Yogo ..... B21D 7/04 72/166

FOREIGN PATENT DOCUMENTS

EP 1 458 505 2/2007
WO 03/053606 7/2003

* cited by examiner

*Primary Examiner* — Adam J Eiseman
*Assistant Examiner* — Fred C Hammers
(74) *Attorney, Agent, or Firm* — Nixon & Vanderhye

(57) ABSTRACT

The invention relates to a bending machine (M) for bending a workpiece (300), remarkable in that a clamping jaw (511) is supported by a clamping jaw holder (510) receiving at least two clamping jaws (511, 512) arranged back to back, the clamping jaw holder (510) being fastened to a shelf (513) guided and driven in translation on the bending arm (500), the support shelves (600) punctually receiving the clamping jaw holder (510) separated from the shelf (513) and to move it on either side of the bending axis transversely to the advance axis of the workpiece (300) to be bent, independently of the bending arm (500) so that the clamping jaw holder (510) can be fastened again to the shelf (513) once the bending arm (500) has been rotated 180 degrees.

The invention also relates to a bending process.

10 Claims, 11 Drawing Sheets

BENDING MACHINE AND PROCESS

CROSS-REFERENCE TO RELATED APPLICATIONS

This application claims priority to FR 1915509 filed Dec. 23, 2019, the entire contents of each of which are hereby incorporated by reference.

FIELD OF APPLICATION OF THE INVENTION

The invention relates to the field of bending machines and in particular to adaptations allowing the direction of bending to be changed under the best conditions.

DESCRIPTION OF PRIOR ART

There are various right (clockwise rotation) and left (counterclockwise rotation) bending solutions from a tool installed on a bending arm such as that described in document EP1458505. This document describes a machine for bending tubes comprising a fixed frame provided, along its longitudinal axis, with a guide rail on which slides a movable carriage secured to a barrel allowing, via an internal clamping mandrel, the guiding and immobilizing in rotation and in translation of a tube to be bent, at one of its ends a bending head, a bending roller and a bending arm which pivots around the vertical axis of the bending head bending for tube formation. This machine was characterized in that it included:

- a bending arm provided with a clamping jaw holder which moves horizontally in the direction of the bending head, said clamping jaw holder being integral with a clamping jaw which comprises at least one jaw for bending along a clockwise direction of the tube and at least one jaw for bending in an counterclockwise direction of the tube, said jaws being fixed one with respect to the other,
- a bending roller which is fixed on the bending arm and which comprises at least one jaw for bending in a clockwise direction of the tube and at least one jaw for bending in a counterclockwise direction of the tube, said jaws being offset laterally with respect to each other and on either side of the vertical axis of the bending head, a first ruler holder which comprises at least one jaw, for the tight support of the tube during its bending in a clockwise direction, and a second ruler holder which comprises at least one jaw for the tight support of the tube during its bending in a counterclockwise direction.

The principle is always the same: the bending arm rotates from 0° to 180° or from 180° to 0°.

The fact of superimposing tools for bending in a clockwise direction called clockwise and tools for bending in a counterclockwise direction called trigonometric, whether at the level of the bending roller, the clamping jaw or the rulers, is liable to cause collisions between the clamping jaw and the rulers which tightly support the tube being bent when the bending arm is at 0° in one direction or the other.

To avoid these collisions, the solution described in document EP1458505 proposes to give a particular shape to the clamping jaw and to the rulers in order to fit/overlap them. This is the reason why an offset of the bending roller jaws is proposed. Such a solution nevertheless requires the design and manufacture of a special bending tool.

Other solutions propose moving or retracting the clamping jaw and/or the rulers liable to collide, but these solutions today lack rigidity. These solutions are thus more particularly used for bending small tubes which do not require significant efforts.

In addition, these different solutions, if they make it possible to avoid a 0° collision, do not allow bending going beyond. Due to the size of the various constituent elements and in particular the guide and drive means of the ruler holder, the working area remains limited to this angle.

BRIEF DESCRIPTION OF THE INVENTION

Based on the foregoing, the Applicant conducted research aimed at finding a new solution to avoid having a collision between the clamping jaws and the rulers for a bending machine operating clockwise and/or counterclockwise.

A more general goal of this research is to free up as much space as possible so as to allow unimpeded bending.

This research resulted in the design and production of a bending machine for a workpiece to be bent, said machine being of the type comprising a frame and a bending head,

- the workpiece to be bent moving in a controlled manner at least axially relative to the frame,
- said bending head moving transversely to the advance axis of the workpiece to be bent and supporting at least one bending roller provided with a bending jaw, the roller defining a bending axis not parallel to the advance axis of the workpiece to be bent,
- wherein a bending arm is associated with the roller and rotates in a controlled manner around the bending axis,
- wherein at least one clamping jaw is supported by the bending arm and arranged opposite the bending jaw with which it is to cooperate for the purpose of driving the portion of the workpiece to be bent that is clamped between said clamping jaw and said bending jaw, said clamping jaw being movable in a controlled manner on the arm in order to clamp or unclamp said portion of the workpiece to be bent,
- a ruler support module, called ruler holder, sliding parallel to the advance axis of the workpiece to be bent and supporting at least two straight members, hereinafter called "rulers", arranged back-to-back, the workpiece to be bent being in contact with one of the rulers during its bending, the ruler holder being driven and guided in translation on the bending head transversely to the advance axis of the workpiece to be bent.

According to the invention, the bending machine is remarkable in that said clamping jaw is supported by a clamping jaw holder accommodating at least two clamping jaws arranged back-to-back, the clamping jaw holder being dismountablly attached to a shelf which is guided and driven in translation on the bending arm, the ruler holder is equipped with punctual fastening means of the clamping jaw holder so as to accommodate the clamping jaw holder separated from the shelf and to move it on either side of the bending axis in its starting position transversely to the advance axis of the workpiece to be bent, independently of the bending arm so that the clamping jaw holder can be fastened again to the shelf once the bending arm has been rotated 180 degrees.

The guidance in translation makes it possible to bring the clamping jaw closer and further away from the jaw provided on the roller in order to tighten and loosen the portion of the workpiece to be bent. The dismountability of the clamping jaw holder not only allows the replacement of the clamping jaws but also the displacement of the clamping jaw in its initial orientation when the arm changes position during the change of bending direction.

Indeed, the change of position of the arm during the change of bending direction results in a symmetrical arrangement of the clamping jaw holder relative to the bending axis. If this bending position does not correspond to the bending range, the dismountability of the clamping jaw holder makes it possible, for example, to keep the primary orientation of the clamping jaws and thus to use the clamping jaw arranged on the back of the first clamping jaw for the next bending operation.

This feature is therefore particularly advantageous in that it allows the clamping jaw holder to be punctually freed from the bending arm and then to fasten again one to the other once the bending arm is in the new starting position.

This feature further allows the use of different prone clamping jaw depending on the direction of the bending to be achieved.

The punctual fastening can be implemented by any fastening means controlled by direct control or by the movements of the different subassemblies.

This movement can facilitate the change of the clamping jaw holder, but it has the additional advantage of providing the clamping jaw holder with a movement means while respecting its original orientation in order to use the clamping jaw arranged on the back of the clamping jaw used in the previous bending phase. It allows a repositioning at the zero point of the stroke without requiring a movement of the shelf with respect to the arm.

This feature is also particularly advantageous in that it provides, as regards the bending head, a transverse mobility (with respect to the advance axis of the workpiece to be bent) of, on the one hand, the ruler holder supporting at least two rulers each oriented for a different bending direction, and, on the other hand, of the assembly formed by the roller and the bending arm.

These motilities add to the mobility of the bending head with respect to the bending machine frame.

The addition of motilities makes it possible to reposition the assembly formed by the roller and the arm and the ruler holder with respect to the workpiece to be bent (repositioning made necessary for a change of bending direction) by decreasing the length of the strokes required for this repositioning. The bending head can thus be less cumbersome and make possible to achieve the bending by positioning the roller and arm assembly at the end of the stroke where neither the bending head itself nor the guiding means of the ruler holder (or the ruler holder itself) impede rotation beyond 180 degrees.

In addition, the bending head is more compact and rigid.

The bending capabilities of a bending machine according to the invention are thus increased in terms of angular span, of stress to be exerted and supported and in precision.

The bending machines of the prior art that bend in both directions use only one horizontal movement. As a result, the possible range of movement of the tube during bending is reduced by the table structure guiding and driving the ruler holder. This is no longer the case with the bending machine of the invention.

According to another particularly advantageous feature of the invention, said punctual fastening means include male or female shapes fitted to the ruler holder and cooperating with corresponding female or male preformed shapes in the clamping jaw holder for the purpose of accommodating and moving the clamping jaw holder on both sides of the bending axis.

According to another particularly advantageous feature of the invention, the ruler holder comprises:

- a part movable in translation for the purpose of sliding parallel to the advance axis of the workpiece to be bent, said movable part supporting said rulers,
- a part fixed in translation parallel to the advance axis of the workpiece to be bent on which said movable part slides, said fixed part being provided with said male or female shapes.

According to another particularly advantageous feature of the invention, said clamping jaw holder is equipped with male or female shapes cooperating with corresponding female or male shapes fitted to said shelf.

According to another particularly advantageous feature of the invention, said clamping jaw holder is provided with male cylindrical projections preformed with flats cooperating with buttonhole-shaped holes each associating a large-diameter hole with a smaller and oblong hole in order to retain the clamping jaw holder or release it depending on the position of its projections in said buttonhole-shaped holes.

According to another particularly advantageous feature of the invention, the bending head accommodates two pairs of horizontal guide rails transverse to the advance axis of the workpiece to be bent:

- a first pair of rails arranged horizontally for guiding the ruler holder module,
- a second pair of rails arranged vertically for guiding the roller and bending arm assembly.

According to another particularly advantageous feature of the invention, the workpiece to be bent is brought to the bending head by means of a carriage guided and driven in translation on the frame parallel to the axis of the workpiece to be bent.

Another particularly advantageous feature of the invention is that the bending arm with the bending roller is driven and guided in translation on the bending head transversely to the advance axis of the workpiece to be bent and parallel to the transverse movement of the ruler holder.

According to another particularly advantageous feature of the invention, the bending head has a substantially parallelepipedal body of which:

- the vertical rear side cooperates with the frame for horizontal and vertical guiding and driving of the entire bending head;
- the horizontal upper side cooperates with the ruler holder for horizontal transverse guiding and driving of the latter;
- the vertical front side cooperates with the roller and bending arm assembly for horizontal and vertical guiding and driving of this assembly.

The different controlled movements of the respective subassemblies allow the movements necessary for the automatic assembly/disassembly of the clamping jaw holder not only with respect to the ruler holder, but also with respect to the shelf attached to the arm.

Thus, the invention also concerns a bending process executed by a bending machine, wherein the process includes bending phases in one direction then in the other, said process being remarkable in that it comprises the following phases:

- punctual fastening of the clamping jaw holder equipping the bending arm to the ruler holder,
- dismounting of the clamping jaw holder from the bending arm,
- rotating the bending arm,
- moving the ruler holder with the clamping jaw holder fastened thereon, fastening the clamping jaw holder to the bending arm having reached its new starting position, dismounting of the clamping jaw holder from the ruler holder.

The clamping jaw holder can therefore be mounted either on one side or on the other side of the bending axis in a bending machine.

The ability to automatically change the position of the clamping jaw holder makes it possible to:

configure the machine with a clockwise or trigo bending direction without human intervention have the possibility of bending clockwise and trigo on a same workpiece, avoid having to move the clamping jaw holder perpendicular to the longitudinal axis of the bending arm to place the clamping jaw at the zero point of the stroke.

This new design is much more rigid and will apply to small tubes but also to large tubes. Such a solution is particularly suited to the needs of users in that many of them use very little right and left bending on the same part. Versatility is sought for a bender that can bend right or left or occasionally right and left.

The invention allows these three operating modes to work in good conditions and to switch from one mode to another without human intervention.

The description which will follow with regard to the accompanying drawings, given by way of non-limiting examples, will make it possible to better understand the invention, the features thereof and the advantages that it is likely to provide.

DESCRIPTION OF AN EMBODIMENT

Figure 1:
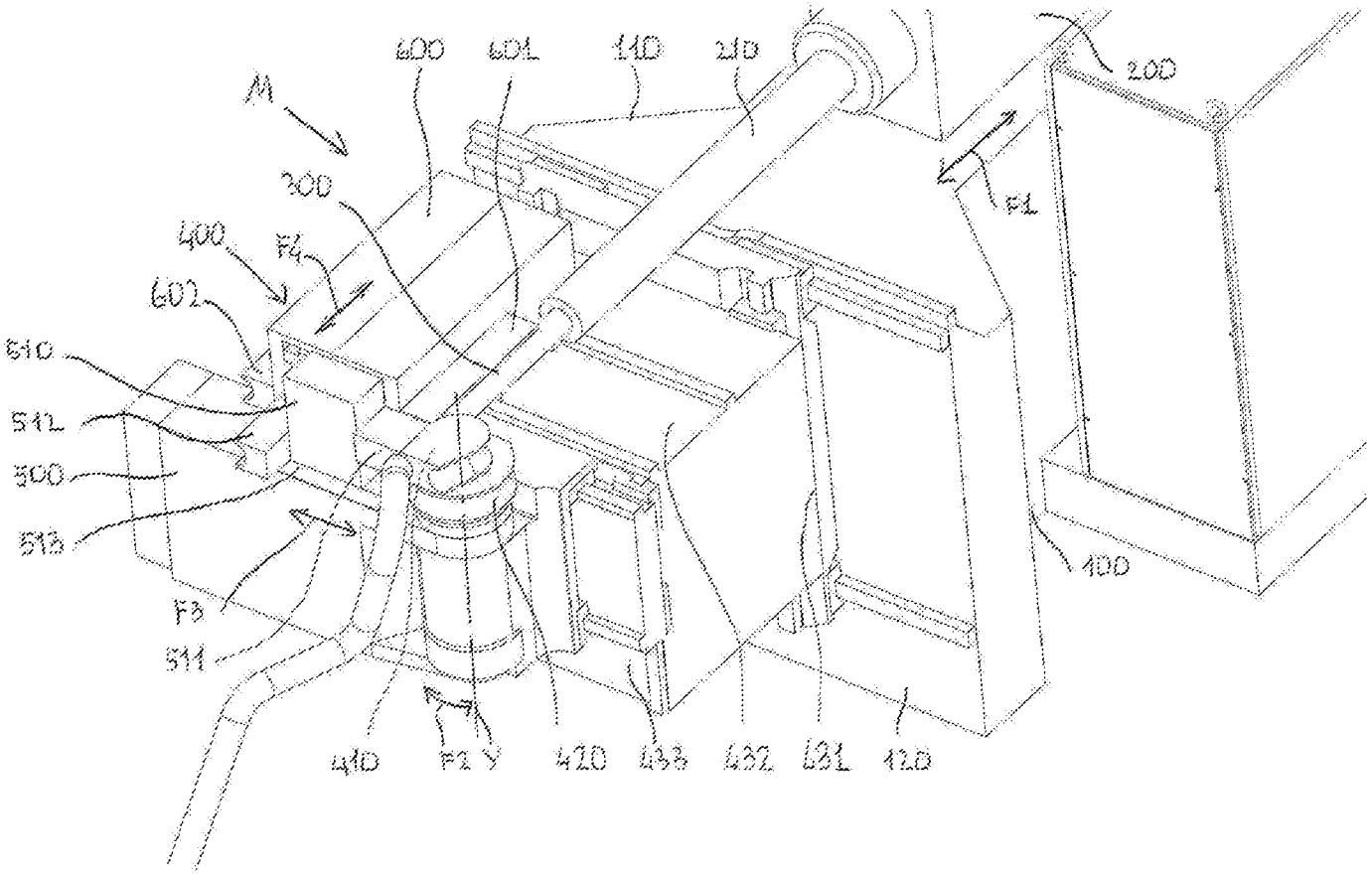
FIGS. 1 to 9 are schematic drawings of perspective views of a same bending head of an embodiment of a bending machine according to the invention executing a plurality of operations related to bending.

As illustrated in FIG. 1, the bending machine denoted M as a whole comprises a fixed frame 100 on the upper surface 110 of which slides along the double arrow F1 a mobile carriage 200 provided with a carriage hollow shaft 210 in which the workpiece 300 to be bent is arranged (here a tube).

This hollow shaft 210 allows through an internal clamping mandrel the said tube 300 to be guided and immobilized in rotation and in translation. It also defines the advance axis of the tube.

Frame 100 has a vertical front face 120, relative to which a bending head 400 moves. This bending head 400 includes:

two bending rollers 410 and 420 defining a vertical bending axis Y and each intended for bending in a different direction, a bending arm 500 that pivots around the vertical axis Y for the bending of the tube 300 according to the double arrow F2. The bending arm 500 is shown here positioned for bending in the trigonometric direction. It is cinematically associated with the rollers.

The bending arm 500 is provided with a clamping jaw holder 510 that moves horizontally in translation according to the double arrow F3. It moves towards the bending roller 410, which is preformed with a jaw to clamp a portion of tube 300 between the arm and the roller.

This clamping jaw holder 510 is provided with two clamping jaws arranged back to back:

a first clamping jaw 511 is intended to cooperate with a jaw 410' of the roller 410 for bending in the trigonometric direction, a second clamping jaw 512 arranged symmetrically, i.e., back to back with respect to the first clamping jaw, and intended to cooperate with a jaw 420' of the roller 420 for clockwise bending.

The bending head 400 also comprises a ruler holder 600 with at least two straight members 601 and 602, hereinafter called "rulers", arranged back-to-back:

a first ruler 601 for the tight support of the tube when bending counterclockwise, and a second ruler 602 for the tight support of the tube when bending clockwise.

To achieve this tight support, the ruler holder 600 is movable in translation according to double-arrow F4.

According to the invention, the bending head 400 is designed to achieve a plurality of additional movements.

To do this, it has a substantially parallelepiped 430 body, of which:

the vertical rear face 431 cooperates with the vertical front face 120 defined by the frame 100 for horizontal and vertical guidance and drive of the entire bending head 400;

the horizontal top face 432 cooperates with the ruler holder 600 for horizontal guidance and drive of the latter allowing it not only to bring a ruler in contact with the tube but also to make the ruler holder 600 move on each side of the axis of the tube so as to use any of the rulers 601 or 602 it supports;

the vertical front face 433 cooperates with the assembly formed by the bending rollers 410, 420 and the arm 500 for horizontal and vertical guidance and drive of this assembly.

As illustrated, the execution of a motion in translation on an axis is carried out by pairs of rails 431, 437 possibly associated with a cross-shelf for an associated perpendicular motion in translation.

As shown, the bending head 400 of the invention is very compact.

In the phase of the bending range illustrated by the drawing in FIG. 1, the bending arm, the tube 300 and the rollers are arranged so that counterclockwise bending can take place. A portion of the tube 300 is clamped between the roller 410 and the clamping jaw 511. The ruler 601 is in contact with the tube 300.

Figure 2:
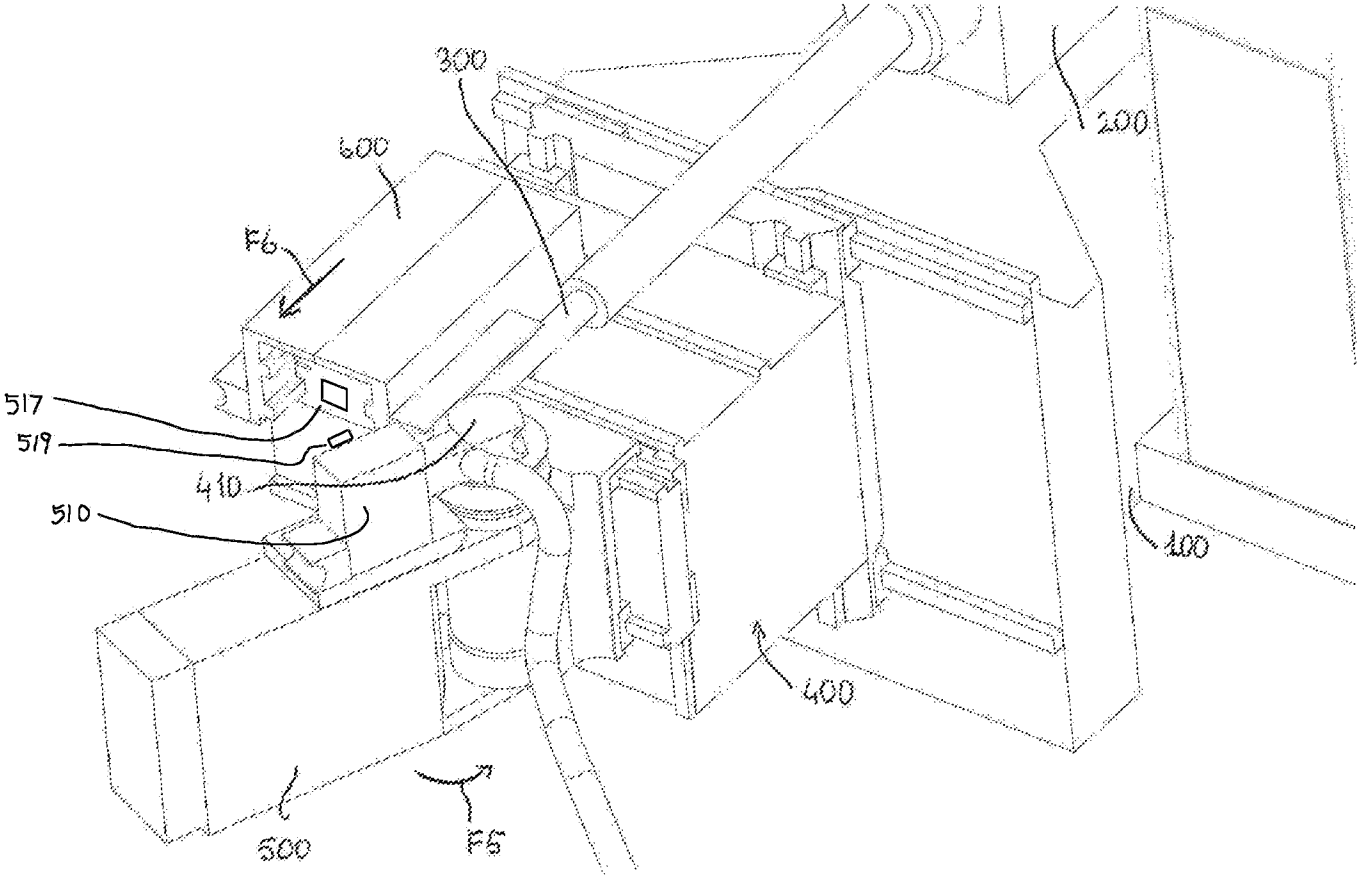

From this position, as shown in FIG. 2, the bending arm 500 starts a counterclockwise rotation according to the arrow F5 about the Y axis of the rollers. The ruler holder 600 moves together with the tube 300 with a translation parallel to the axis of the tube 300 according to the arrow F6.

Figure 3:
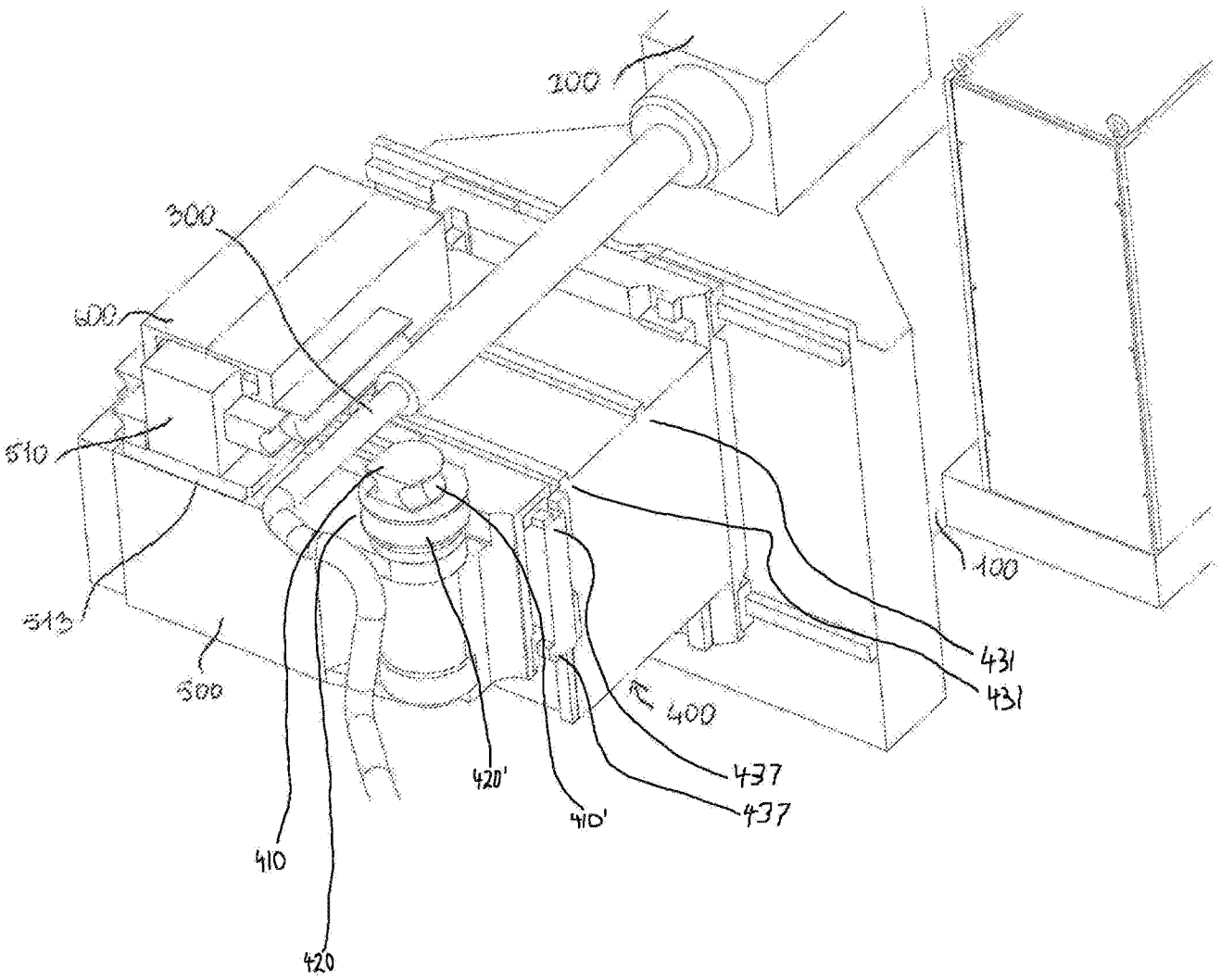
Figure 4:
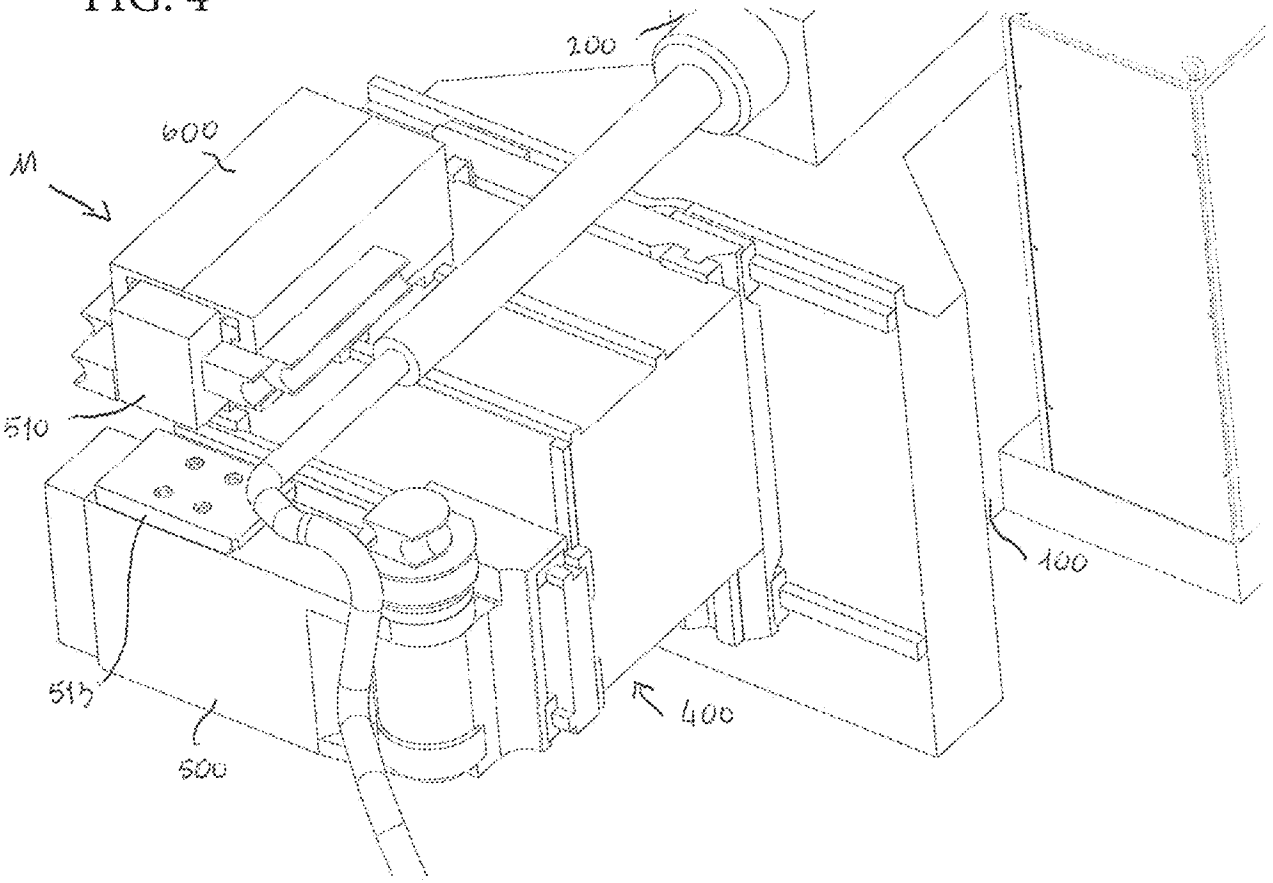

Once the bending has been completed, as illustrated in FIG. 3, the clamping jaw holder 510 moves away from the roller 410 and the bending arm 500 returns to the starting position. The clamping jaw holder 510 is positioned relative to the ruler holder 600 so that the clamping jaw holder 510 is punctually fastened to the ruler holder 600 and is separated from the shelf 513 of the arm 500 as illustrated in FIG. 4. To this end, the clamping jaw holder 510 is fixed in a removable manner to a shelf 513 guided and driven in translation on the bending arm 500 and the ruler holder 600 comprises means for gripping and/or accommodating the clamping jaw holder 510.

Figure 10:
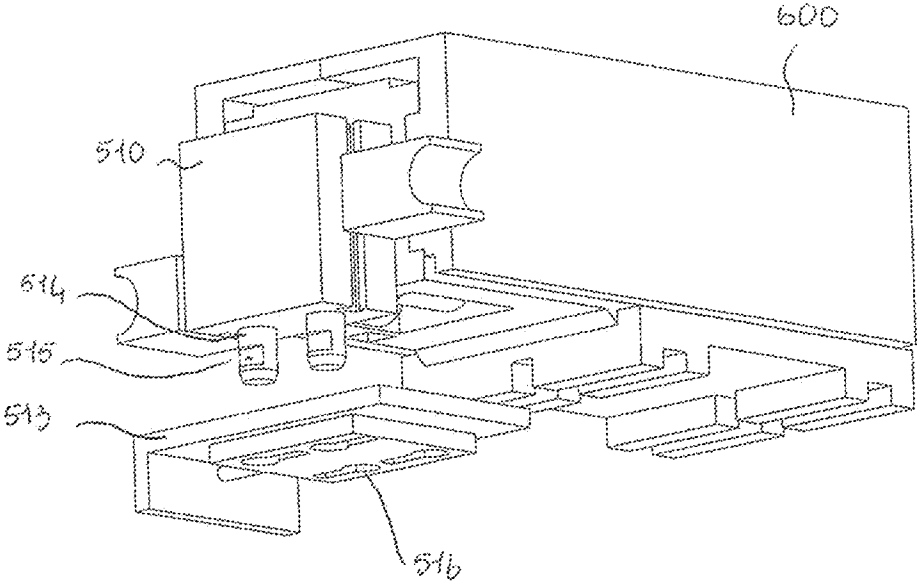
FIG. 10 is a drawing of a detail perspective view of the clamping jaw holder associated with the ruler holder and separated from the shelf.
Figure 11:
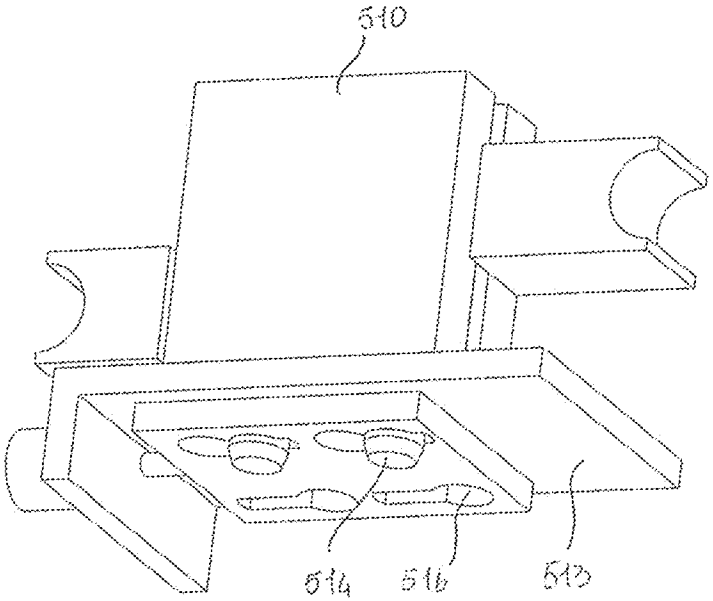
FIG. 11 is a drawing of a detail perspective view of the clamping jaw holder fastened to the shelf.

Several solutions for fastening the clamping jaw holder 510 to the shelf 513 have been considered. For example, in a non-limiting manner, this fastening can be achieved by clamping the clamping jaw holder on the shelf through buttonhole-type means moved pneumatically. An example is illustrated by FIGS. 10 and 11.

Referring to these figures, said clamping jaw holder 510 is provided with male shapes cooperating with corresponding female shapes fitted to said shelf 513. More precisely, said clamping jaw holder 510 is provided with male cylindrical projections 514 preformed with flats 515 cooperating with buttonhole-shaped holes 516 associating a large diameter hole with a smaller and oblong hole in order to retain or release the clamping jaw holder according to the position of its projections in said buttonhole holes.

Several solutions for fastening the clamping jaw holder 510 with respect to the ruler holder 600 have also been considered.

According to one embodiment, said punctual fastening means comprise male or female shapes 517 fitted to the ruler support 600 and cooperating with corresponding female or male shapes 519 preformed in the clamping jaw holder 510 for reception and displacement purposes of the clamping jaw holder 510 on either side of the bending axis.

The ruler holder 600 includes:

a part movable in translation for sliding parallel to the advance axis of the workpiece 300 to be bent, said movable part supporting said rulers, a fixed part being fixed in translation parallel to the advance axis of the workpiece 300 to be bent on which the said movable part slides, said fixed part being provided with said male or female shapes.

For example, in a non-limiting manner, this fastening can be achieved by 2 axes which pneumatically come out of the said fixed part and which hold the clamping jaw holder 510 in position during the lateral movement of the ruler holder 600. Another solution is a magnetic solution.

Another solution for fastening/detachment uses "Belleville" cones and washers.

The bending head 400 is first lowered with respect to tube 300 to allow the movements of the next phase in preparation for the next bending operation to be performed in a clockwise direction.

Figure 5:
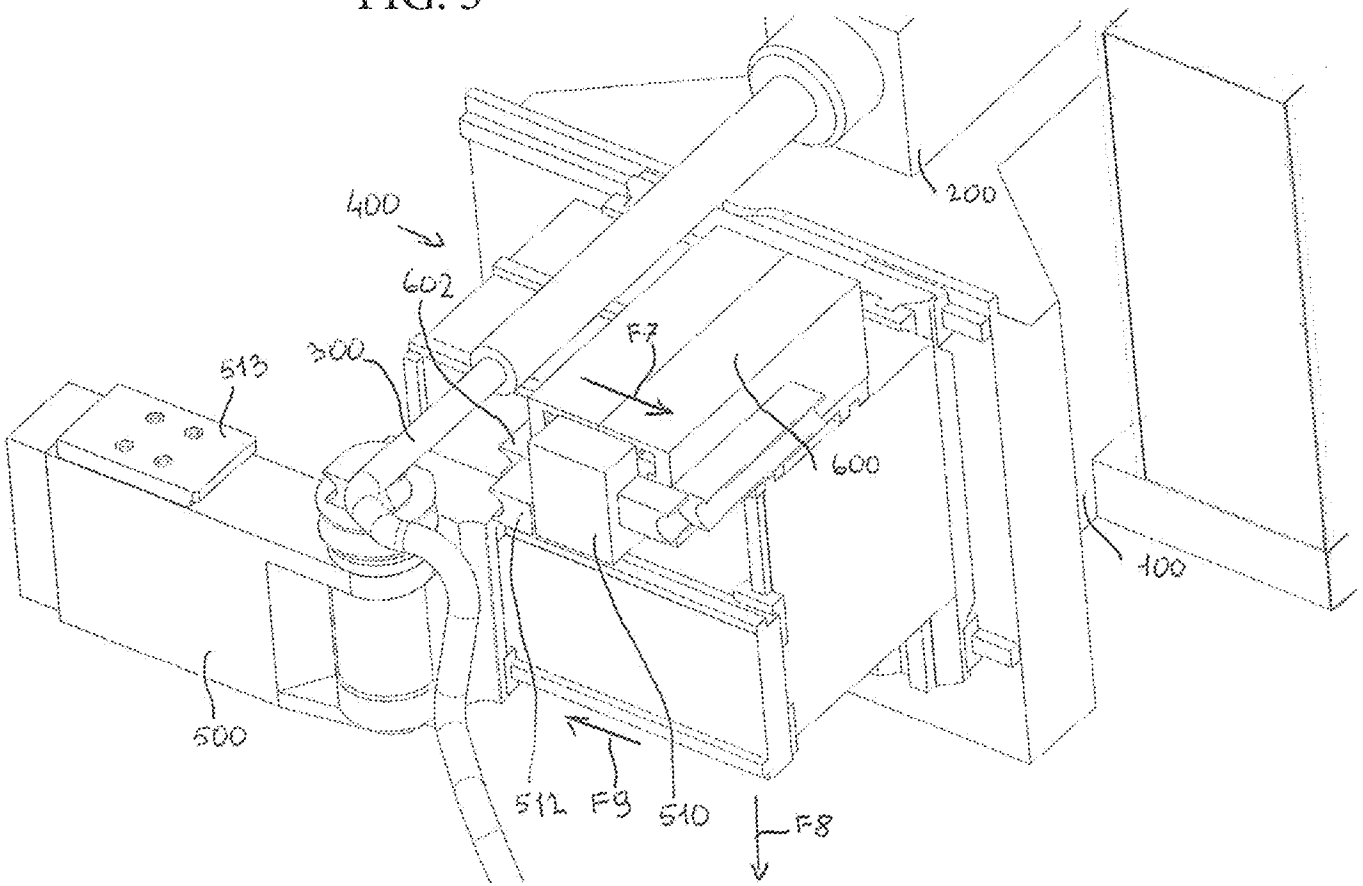

As shown in FIG. 5, the clamping jaw holder 600 with the clamping jaw holder 510 punctually fastened thereto is moved in translation according to arrow F7 to the other side of the advance axis of tube 300 in order to position the ruler 602 in the working position and also to move the clamping jaw holder 510 in its initial orientation without reversing its position in order to use the clamping jaw 512.

The arm and roller assembly is moved in translation according to arrow F8 and arrow F9 to move to the other side of the advance axis of the tube 300.

Figure 6:
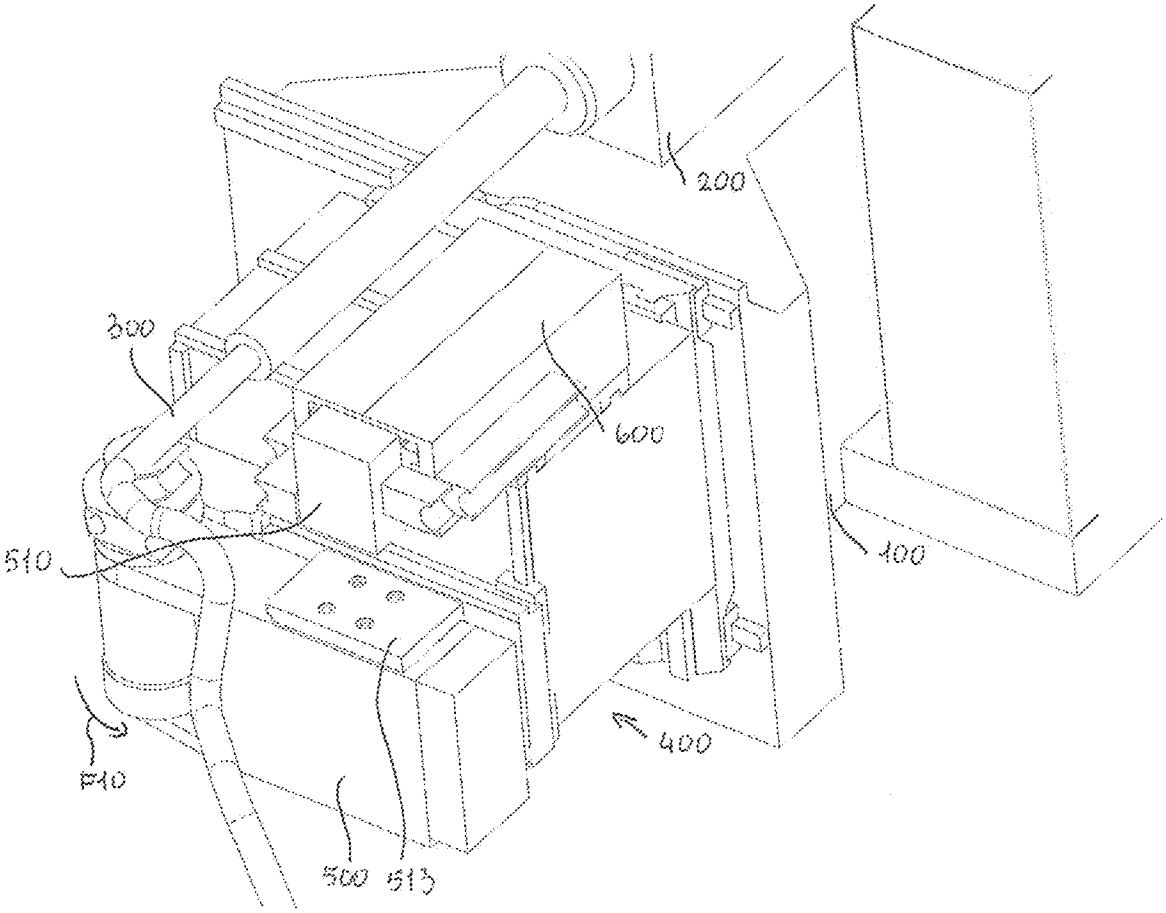

As shown in FIG. 6, the arm 500 is positioned by rotating according to the arrow F10, in the starting position for a clockwise bending. The shelf 513 then moves into position along the arm 500 so as to be placed below the clamping jaw holder 510 carried by the ruler holder 600.

Figure 7:
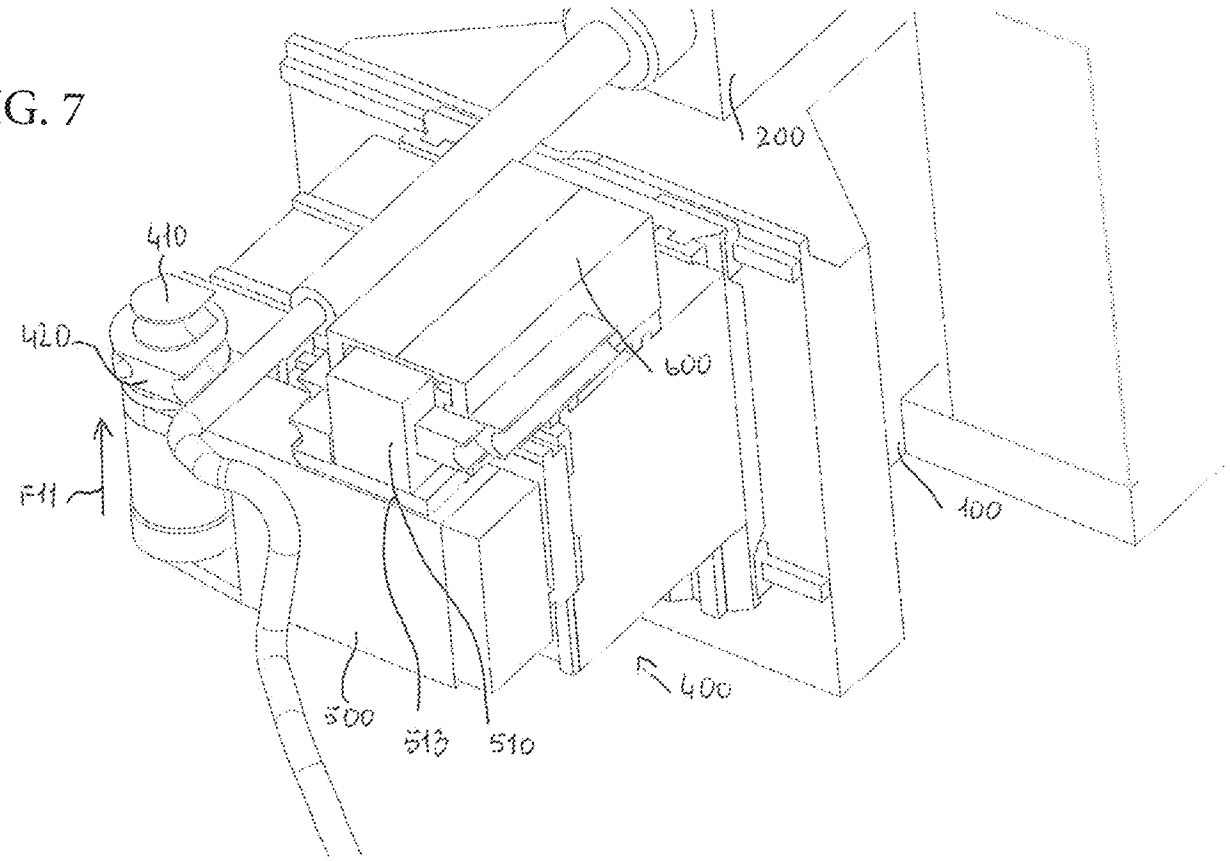

As shown in FIG. 7, the arm and roller assembly moves up in translation according to arrow F11 to allow the fastening of the clamping jaw holder 510 to the shelf 513 and the separation between the clamping jaw holder 510 and the ruler holder 600. This movement also makes it possible to put at the right height the roller 420 which will be used for bending clockwise.

Figure 8:
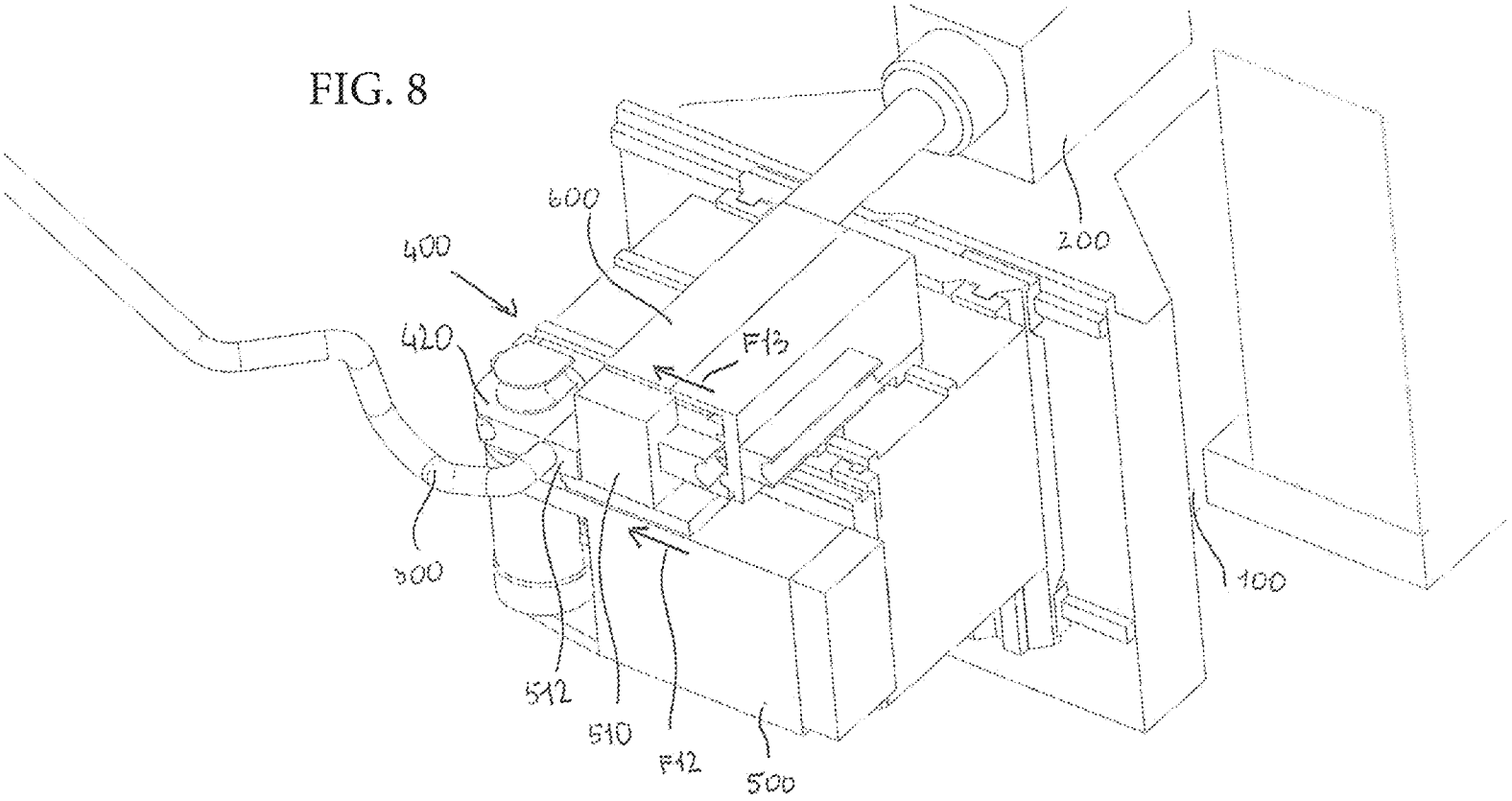

From this position, as shown in FIG. 8, the clamping jaw holder 510 is moved in translation according to the arrow F12 along the arm 500 to tighten the portion of the tube 300 to be bent between the roller 420 and the clamping jaw 512. In the same way, the ruler holder 600 is moved in translation according to the arrow F13 on the bending head 400 for the shelf 602 to come in contact with the tube 300 and to tightly support this tube for bending.

Figure 9:
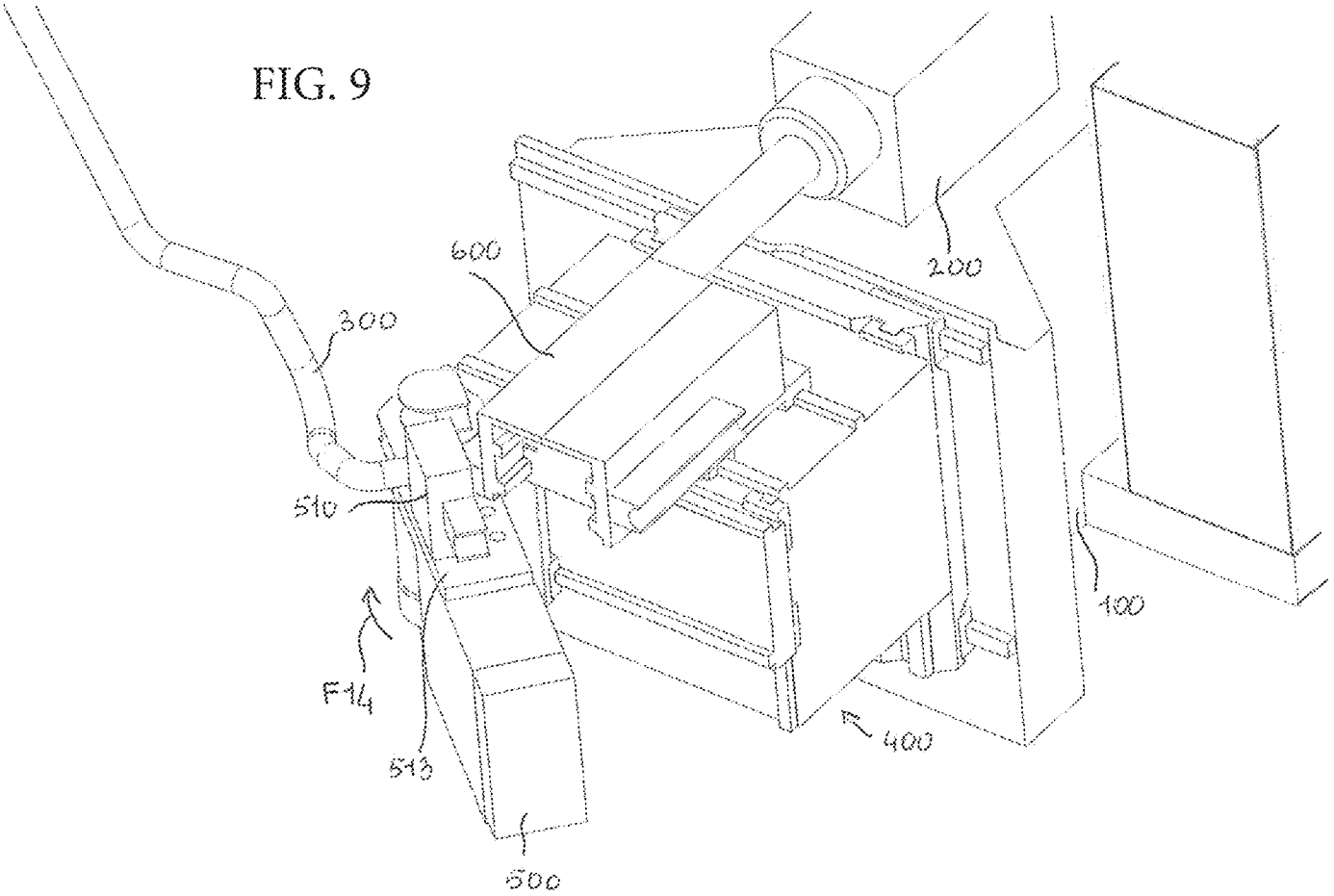

FIG. 9 shows the clockwise bending according to arrow F14.

FIG. 9 clearly illustrates the increased angular possibilities of the bending machine of the invention which, by the increased movement capacities of its respective subassemblies can position the arm and roller assembly at the end of the transverse translation stroke. This positional position ensures that there is no obstacle to the rotation of the arm 500 according to the arrow F14 going beyond 180 degrees.

Of course, various arrangements, modifications and improvements can be made to the above examples, without departing from the scope of the invention.

The invention claimed is:

1. A bending machine (M) for bending a workpiece (300), comprising:

a frame (100); and a bending head (400), the workpiece (300) to be bent being movable in a controlled manner at least axially relative to the frame (100), said bending head (400) moving transversely to an advance axis of the workpiece (300) to be bent and supporting at least one bending roller (410, 420) provided with a bending jaw, the roller (410, 420) defining a bending axis not parallel to the advance axis of the workpiece (300) to be bent, a bending arm (500) being associated with said roller (410, 420) and rotating in a controlled manner about the bending axis, at least one clamping jaw (511, 512) supported by the bending arm (500) and arranged opposite the bending jaw with which the at least one clamping jaw is to cooperate for the purpose of driving a portion of workpiece (300) to be bent in a clamped manner between said clamping jaw (511, 512) and said bending jaw, said clamping jaw (511, 512) being movable in a controlled manner on the arm (500) in order to clamp or unclamp said portion of the workpiece (300) to be bent, a ruler holder (600) configured to slide parallel to an advance axis of the workpiece (300) to be bent and supporting at least two straight rulers (601, 602) arranged back-to-back, the workpiece (300) to be bent being in contact with a first ruler of said rulers during the bending thereof, the ruler holder being driven and guided in translation on the bending head (400) transversely to the advance axis of the workpiece (300) to be bent, wherein: said clamping jaw (511) is supported by a clamping jaw holder (510) accommodating at least two clamping jaws (511, 512) arranged back-to-back, the clamping jaw holder (510) is reversibly fastened to a shelf (513), which is guided and driven in translation on the bending arm (500), and the ruler holder (600) and the clamping jaw holder (510) are provided with fastening means configured such that the ruler holder (600) accommodates the clamping jaw holder (510) separated from the shelf (513) and enables movement of the clamping jaw holder (510) on either side of the bending axis in a starting position transverse to the advance axis of the workpiece (300) to be bent and independently of the bending arm (500) so that the clamping jaw holder (510) can be fastened to the shelf (513) once the bending arm (500) is rotated 180 degrees.

2. The bending machine (M) according to claim 1, wherein said fastening means is formed of a first of male and female shapes provided on the ruler holder (600), configured to cooperate with a corresponding second of said male and female shapes preformed in the clamping jaw holder (510) for reception and displacement of the clamping jaw holder (510) on either side of the bending axis.

3. The bending machine (M) according to claim 2, wherein said ruler holder comprises:

a part movable in translation for sliding parallel to an advance axis of the workpiece (300) to be bent, said movable part supporting said rulers; and a fixed part that is fixed in translation parallel to the advance axis of the workpiece (300) to be bent, on which said movable part slides, said fixed part being provided with the first of said male or female shapes.

4. The bending machine (M) according to claim 1, wherein said clamping jaw holder (510) is provided with a first of male and female shapes cooperating with a corresponding second of said male and female shapes provided on said shelf (513).

5. The bending machine (M) according to claim 1, wherein said clamping jaw holder (510) is provided with male cylindrical projections preformed with flats for cooperating with buttonhole-shaped holes formed of a large-diameter hole with a smaller and oblong hole for retaining the clamping jaw holder or releasing the clamping jaw holder, depending on a position of the cylindrical projections in said buttonhole-shaped holes.

6. The bending machine (M) according to claim 1, wherein the bending head (400) accommodates a first pair of horizontally arranged rails for guiding the ruler holder (600), and a second pair of vertically arranged rails for guiding an assembly formed by the roller (410, 420) and the bending arm (500).

7. The bending machine (M) according to claim 1, wherein the workpiece (300) to be bent is brought to the bending head by means of a guided carriage (200) and driven in translation on the frame (100) parallel to an axis of the workpiece (300) to be bent.

8. The bending machine (M) according to claim 1, wherein the bending arm (500) associated with the bending roller (410, 420) is driven and guided in translation on the bending head (400) transversely to an advance axis of the workpiece (300) to be bent and parallel to the transverse movement of the ruler holder (600).

9. The bending machine (M) according to claim 1, wherein the bending head (400) has a parallelepiped body (430) comprising a vertical rear face (431), a horizontal upper face (432), and a vertical front face (433), the vertical rear face (431) cooperating with the frame (100) for horizontal and vertical guidance and drive of the bending head (400), the horizontal upper face (432) cooperating with the ruler holder (600) for horizontal and transverse guidance and drive of the ruler holder (600), and the vertical front face (433) cooperating with the assembly formed by the roller (410, 420) and the bending arm (500) for horizontal and vertical guidance and drive of the parallelepiped body.

10. A bending process executed by the bending machine (M) according to claim 1, wherein the process comprises:

fastening the clamping jaw holder (510) provided on the bending arm (500) to the ruler holder (600);

moving the clamping jaw holder (510) from the bending arm (500);

rotating the bending arm (500);

moving the ruler holder (600) with the clamping jaw holder (510) fastened thereto;

fastening the clamping jaw holder (510) on the bending arm (500) upon reaching a new starting position; and moving the clamping jaw holder (510) from the ruler holder (600).

* * * * *